US006576302B1

(12) United States Patent
Mizuta et al.

(10) Patent No.: US 6,576,302 B1
(45) Date of Patent: Jun. 10, 2003

(54) METHOD FOR PRODUCING A METAL OXIDE AND METHOD FOR FORMING A MINUTE PATTERN

(75) Inventors: Susumu Mizuta, Tsukuba (JP); Tetsuo Tsuchiya, Tsukuba (JP); Akio Watanabe, Tsukuba (JP); Yoji Imai, Tsukuba (JP); Iwao Yamaguchi, Tsukuba (JP); Toshiya Kumagai, Tsukuba (JP); Takaaki Manabe, Tsukuba (JP); Hiroyuki Niino, Tsukuba (JP); Akira Yabe, Tsukuba (JP)

(73) Assignee: Agency of Industrial Science and Technology, Tokyo (JP)

( * ) Notice: Subject to any disclaimer, the term of this patent is extended or adjusted under 35 U.S.C. 154(b) by 0 days.

(21) Appl. No.: 09/513,814

(22) Filed: Feb. 25, 2000

(30) Foreign Application Priority Data

Feb. 25, 1999 (JP) ..... 11-047500
May 17, 1999 (JP) ..... 11-136206
Oct. 29, 1999 (JP) ..... 11-308644

(51) Int. Cl.[7] ..... C08J 7/18; C08F 2/48

(52) U.S. Cl. ..... 427/597; 427/596; 427/595; 427/492; 427/554; 427/556; 427/508

(58) Field of Search ..... 427/510, 492, 427/487, 508, 581, 595, 596, 597, 63, 62, 53.1, 54.1, 43.1, 226, 299, 419.2, 533, 270, 272, 282, 377, 380, 383.1, 404, 419.3, 554, 556

(56) References Cited

U.S. PATENT DOCUMENTS

| | | | | | |
|---|---|---|---|---|---|
| 3,687,910 | A | * | 8/1972 | Jones | 260/80.78 |
| 4,064,832 | A | * | 12/1977 | Chujo et al. | 118/323 |
| 4,916,115 | A | | 4/1990 | Mantese et al. | 505/1 |
| 4,952,556 | A | | 8/1990 | Mantese et al. | 505/1 |
| 5,021,398 | A | * | 6/1991 | Sharma et al. | 505/1 |
| 5,057,335 | A | | 10/1991 | Hanagata et al. | 427/53.1 |
| 5,091,626 | A | * | 2/1992 | Lewis et al. | 219/121.69 |
| 5,119,760 | A | | 6/1992 | McMillan et al. | 118/722 |
| 5,196,388 | A | * | 3/1993 | Shyu | 501/134 |
| 5,268,198 | A | * | 12/1993 | Yamasaki et al. | 427/226 |
| 5,271,797 | A | | 12/1993 | Kamisawa | 156/635 |
| 5,534,312 | A | * | 7/1996 | Hill et al. | 427/533 |
| 5,630,872 | A | | 5/1997 | Ogi et al. | 106/287.18 |
| 5,681,687 | A | * | 10/1997 | Lelental et al. | 430/530 |
| 5,721,009 | A | * | 2/1998 | Dougherty et al. | 427/126.6 |
| 5,789,039 | A | * | 8/1998 | Biller et al. | 427/508 |
| 5,849,465 | A | * | 12/1998 | Uchida et al. | 430/325 |
| 5,965,325 | A | * | 10/1999 | Matsuo et al. | 430/287.1 |
| 6,326,216 | B1 | * | 12/2001 | Kato et al. | 438/3 |

FOREIGN PATENT DOCUMENTS

| | | | |
|---|---|---|---|
| EP | 0310248 | A2 | 4/1989 |
| EP | 0324615 | A2 | 7/1989 |
| EP | 0940368 | A1 | 9/1999 |
| GB | 2257438 | A | 1/1993 |
| GB | 2257439 | A | 1/1993 |
| JP | B-313282 | | 4/1931 |
| JP | 6487780 | | 3/1989 |
| JP | A-280306 | | 3/1990 |
| JP | A-3218908 | | 9/1991 |
| JP | A-594991 | | 4/1993 |
| JP | 5247658 | | 9/1993 |
| JP | 8225950 | | 9/1996 |
| JP | 8260159 | | 10/1996 |
| JP | 8283949 | | 10/1996 |
| JP | 9157855 | | 6/1997 |
| JP | 10219462 | | 8/1998 |
| JP | 11106935 | | 4/1999 |
| JP | 11256342 | | 9/1999 |
| JP | 11288625 | | 10/1999 |
| JP | 2000016812 | A | 1/2000 |
| JP | 2000161812 | | 6/2000 |
| WO | WO9727346 | | 7/1997 |

OTHER PUBLICATIONS

Ceramics, 21, 236 (1986).
Inorg. Chem. 8 1863 (1969).
Inorg. Chem. 9 1728 (1970).
J. Am. Chem. Soc. 93 1623 (1971).
Jpn. J. Appl. Phys. vol. 36, Part 1, No. 8, pp. 5221–5225 (1997).
Trans. Mater. Res. Soc. Jpn., 20, p. 636–639.
Jpn. J. Appl. Phys. vol. 32, pp. 4141–4143 (1993).
J. Appl. Phys. 85 (1999)203.
Jpn. J. Appl. Phys. 33 L1181 (1994).
Japanese Abstract—JP 3140473, No date.
Japanese Abstract—JP 1200593, No date.
Japanese Abstract—JP 63076886, No date.
Japanese Abstract—JP 58006527, No date.

* cited by examiner

*Primary Examiner*—Shrive P. Beck
*Assistant Examiner*—Eric B Fuller
(74) *Attorney, Agent, or Firm*—Birch, Stewart, Kolasch & Birch, LLP

(57) ABSTRACT

There is disclosed a method for producing a metal oxide, which comprises the steps of: dissolving a metal organic compound (e.g. a metal organic acid salt, a metal acetylacetonato complex, and a metal alkoxide having an organic group with 6 or more carbon atoms) in a solvent to provide a state of solution, applying the solution onto a substrate, drying the solution, and subjecting the resultant substrate to irradiation with a laser light of a 400 nm or less wavelength, to form a metal oxide on the substrate. According to that method, a metal oxide can be produced without applying a heat treatment at a high temperature of the degree adopted in the conventionally known application thermal decomposition method.

18 Claims, No Drawings

METHOD FOR PRODUCING A METAL OXIDE AND METHOD FOR FORMING A MINUTE PATTERN

FIELD OF THE INVENTION

The present invention relates to a method for producing a metal oxide. The present invention also relates to a method for forming a minute pattern.

BACKGROUND OF THE INVENTION

Formation of a thin film made up of a metal film, a metal oxide film, or a composite oxide film on a substrate, is actively performed in the field of the semiconductor production technology. In forming the metal film, the metal oxide film, or the composite oxide film on the substrate, a method of using a metal organic compound containing the metal species as a raw material, applying a homogeneous solution, obtained by dissolving the compound in a solvent, onto the substrate, heating, and baking, has been usually utilized.

However, in general, according to the method, in producing a metal oxide by heating and baking after application, metal ions which can be the cores aggregate together, to cause crystal growth and powdering. In order to eliminate this problem, it is considered necessary to take a measure to prevent contact of the metal ions with each other; that is, a means to isolate the metal ions by utilizing the steric hindrance effect. As such a means, specifically, separation of the metal ions by a large organic group can be considered.

Based on the idea, if an organic group bonding metal is selected and is thermally decomposed, core formation and crystal growth are restrained. As a result, a metal oxide can be obtained in the amorphous state, and the same will further be crystallized. Accordingly, when the desired metal oxide is to be in a film state, since it is provided via the amorphous state, a film with an improved film formation property can be obtained, and thus it became known that the film formation itself is not difficult. The above method is called the application thermal decomposition method, and it was extensively studied by Toru Matsushita et al. in the 1970s. The application thermal decomposition method is aimed at forming a metal oxide film or a composite oxide film by applying a homogeneous film of good quality on a substrate, and a heat-baking treatment. T. Matsushita et al. pointed out that an organic group bonding metal compound having a metal-oxygen-carbon bond is suitable as a raw material, and they mainly studied particularly a metal organic acid salt having a large organic group (Ceramics, 21, 236 (1986)).

As a raw material for the above operation, originally, a method of using a metal acetylacetonato complex for forming a metal oxide film on a substrate, by decomposing the metal acetylacetonato, was developed. Specifically, a method of forming a highly functional oxide film by only applying a raw material solution on a substrate, and applying a heat treatment thereto, was proposed, which attracted attention (U.S. Patent by American inventors concerning $In_2O_3$ film (transparent conductive film) in 1956 (M. S. Jaffy et al., JP-B-31-3282 (1956) ("JP-B" means examined Japanese patent publication))).

Studies have been done since then on the methods of using a metal acetylacetonato complex as a raw material. However, as mentioned below, a problem is involved, in that disadvantages of applying heat cannot be avoided.

In contrast, general decomposition or reaction by radiating light onto a metal acetylacetonato complex has been performed since long ago (N. Filipescu et al., Inorg. Chem. 8 1863 (1969)) (H. D. Gafney et al., Inorg. Chem. 9 1728 (1970)) (H. D. Gafney et al., J. Am. Chem. Soc. 93 1623 (1971)).

However, products obtained by these methods so far were not metal oxides; rather, they consisted of a metal or a composition with the valence of the metal ion changed, and no oxide was really obtained.

Meantime, according to the superconductivity fever of the mid 1980s, superconductive epitaxial films, using various kinds of single crystal substrates, were synthesized for the first time by the application thermal decomposition method, using a metal organic acid salt as the raw material (Susumu Mizuta et al., Nihon Kagakukaishi (Journal of the Chemical Society of Japan) 1997, (1) 11–23 (1997); S. Mizuta et al., Japanese Patent Registration No. 1778693; S. Mizuta et al., Japanese Patent Registration No. 1778694; Toshiya Kumagai et al., JP-A-5-14794 ("JP-A" means unexamined published Japanese patent application), and T. Kumagai et al., JP-A-5-9022).

Furthermore, from the 1990s, studies on synthesis of an epitaxial film for production of a ferroelectric substance, such as $Pb(Zr)TiO_3$ (K. Hwang et al., Jpn. J. Appl. Phys. Vol. 36, Part 1, No. 8, pp. 5221–5225 (1997)), $BaTiO_3$ (S. Kim et al., Trans. Mater. Res. Soc. Jpn., 20, p. 636–639 (1996)), $La(Sr)MnO_3$ (T. Manabe et al., J. Mater. Res., 12(2), p. 541–545 (1997)), and $LiNbO_3$ (T. Manabe et al., Trans. Mater. Res. Soc. Jpn., 20, p.599–602 (1996)), have been pursued.

According to a method of producing a metal oxide using a metal acetylacetonato complex, in general, treatment at a high temperature of 500° C. or more is required for decomposing the metal acetylacetonato. According to a recent method (K. Shinmou et al., Jpn. J. Appl. Phys. 33 L1181 (1994)), patterning is performed by adding acetylacetone to a metal alkoxide and radiating with ultraviolet rays, to make the film insoluble. However, a metal oxide cannot be obtained by this method. In order to obtain an oxide, heat treatment is finally necessitated.

Moreover, in the case of using a metal organic acid salt as the raw material, decomposition at 500° C. or more is inevitable, but it is pointed out that such a high temperature thermal decomposition causes several harmful effects on electronics devices.

For example, in the case of using a silicon, it is known that deterioration is caused and laminated films react with each other. In order to prevent deterioration of silicon or reaction among the laminated films, it is said that the heat treatment temperature should be 650° C. or less, desirably 300° C. or less.

As mentioned above, decomposition at a high temperature close to 500° C. is too high for electronics devices, and harmful influences thereby are pointed out. For example, in the case of PZT, which is expected as a dielectric memory, the PbO component thereof reacts with a silicon substrate, to lower the dielectric characteristics. Moreover, for a transparent conductive film made, for example, of indium oxide, which is used as an electrode of photonics, or electronics devices related to a light, such as a liquid crystal display board, a plasma display panel, and a solar battery, a high-temperature heat treatment of the above-mentioned degree is not preferable. In particular, in the case of a color liquid crystal display board, since a film needs to be formed on an organic compound resin color filter, a low-temperature film formation, preferably in the range of 150 to 170° C., is desired. However, there has been no case of converting a metal acetylacetonato complex to an oxide film in 100%-yield by treatment at a relatively low temperature.

Accordingly, a specific example of decomposition at 200° C. or less has not been known so far either in the case of acetylacetonato or a metal organic acid salt. As a heating means, use of various kinds of heat sources are conceivable, but the use of new means has not been known.

As a heating means, radiation by an excimer laser, which radiates ultraviolet rays having a high heating effect and high-level energy, without containing a wavelength at the infrared part, is expected; however, a specific example of producing an oxide using the excimer laser has not been reported so far.

That is, it has been considered to be difficult to decompose a metal acetylacetonato or a metal organic acid salt for synthesizing an oxide directly since both of these are known to be stable. Furthermore, there are no reports on decomposition using a metal alkoxide having an organic group with 6 or more carbon atoms as the raw material. Direct synthesis of an oxide film using an organic group with 5 or less carbon groups, for example, decomposition of an alkoxide comprising i-propoxide as an organic group with 5 or less carbon atoms, is known already. However, in the method, an excimer laser is used in irradiation at the time of crystallization after preliminary polycondensation of the raw material substance (H. Imai et al., J. Appl. Phys. 85 (1999) 203). Thus the excimer laser irradiation is used as an auxiliary means for the polycondensation operation but not for decomposing the alkoxide to directly obtain a metal oxide.

SUMMARY OF THE INVENTION

An object of the present invention is to provide a method for producing a targeted metal oxide without applying a heat treatment at a high temperature of the degree adopted in the conventionally known application thermal decomposition method. According to the method for producing the metal oxide to be formed on the surface of a substrate in the state of a metal oxide film or a composite oxide film, a method capable of enabling a minute process can be provided.

More specifically, another object of the present invention is to provide a method for producing a metal oxide and a metal oxide film without deterioration of the substrate, wherein the metal oxide formed on the substrate is not given a high-temperature heat treatment. Still another object of the present invention is to provide a method for forming a minute pattern.

Other and further objects, features, and advantages of the invention will appear more fully from the following description.

DETAILED DESCRIPTION OF THE INVENTION

The present inventors found that, by irradiation with a laser light having a wavelength of 400 nm or less, to a metal organic compound applied on a substrate, instead of the process of heating and baking at a high temperature of about 500° C., the metal organic compound can be decomposed so as to produce a metal oxide on the substrate, without heating the substrate and the produced film to 500° C. or more. This can be attained since the laser light irradiation has the heating effect and the effect of providing a strong energy of the laser light. As a result, we have completed the present invention based on that finding. The phenomenon of the thermal decomposition according to such the effects were discovered by the present inventors for the first time.

The present inventors also found out newly that, in the case of decomposing a metal organic compound, a metal oxide may be obtained in one step; however, even when the decomposition cannot be occurred in one step, reaction can be carried out by a two-step decomposition reaction. Specifically, for example, we have found that a metal organic acid salt can be decomposed in two steps to obtain a metal oxide, to also thereby complete the present invention.

The matters discussed are as follows.

First, iron 2-ethylhexanoate solution (Fe content 6 wt %) was diluted twofold with toluene. After spin-coating the same on a quartz substrate at 2,000 rpm for 10 seconds, it was dried at 200° C. for 10 minutes. Then, an ArF excimer laser (193 nm) was used to irradiate at 10 Hz and 50 mJ/cm$^2$ for 5 minutes in air, but the iron 2-ethylhexanoate was not decomposed. A two-step irradiation, including a first-step irradiation of 10 mJ/cm$^2$ at 50 Hz for 30 seconds, and a second-step irradiation of 50 mJ/cm$^2$ at 10 Hz for 5 minutes in air, was conducted. The product obtained by the irradiation was analyzed by X-ray diffraction measurement. As a result, production of a $\gamma Fe_2O_3$ film was confirmed.

As to why such plural-step energy irradiation is effective, and why decomposition cannot be done with a one-step irradiation with strong energy enough to cause decomposition, the possibility of ablation by the iron 2-ethylhexanoate is conceivable as one of the reasons, but details are not known yet. Moreover, as to why decomposition can be done by the second irradiation when only weak energy was used in the first-step of preliminary irradiation, it can be conceivable as a result of stabilization of iron 2-ethylhexanoate or an increase of the interaction between iron 2-ethylhexanoate molecules and the substrate according to the removal of the solvent that takes place preliminary in the first-step irradiation.

In either case, it was apparently observed that a metal organic acid salt is decomposed by irradiation of a laser light of a wavelength of 400 nm or less over a plurality of steps, to give a metal oxide.

Furthermore, the present inventors found out that, similarly as to indium 2-ethylhexanoate and tin 2-ethylhexanoate, crystalline $In_2O_3$, $SnO_2$ can be obtained by performing two-step irradiation by an ArF excimer laser light in each case.

The present invention was completed by finding out the above-mentioned phenomena for the first time.

According to the present invention, the following methods are provided.

(1) A method for producing a metal oxide, comprising the steps of: dissolving a metal organic compound in a solvent to provide a state of solution, applying the solution onto a substrate, drying the solution, and subjecting the resultant substrate to irradiation with a laser light of a 400 nm or less wavelength, to form a metal oxide on the substrate.

(2) The method for producing a metal oxide as stated in the above (1), wherein an excimer laser, which uses one selected from the group consisting of ArF, Krf, XeCl, XeF, and $F_2$, is used as the laser light of a 400 nm or less wavelength.

(3) The method for producing a metal oxide as stated in the above (1) or (2), wherein the laser light irradiation of a 400 nm or less wavelength is carried out in a plurality of steps.

(4) The method for producing a metal oxide according to any one of the above (1) to (3), wherein the laser light irradiation of a 400 nm or less wavelength is carried out in a plurality of steps, and wherein the first-step irradiation is carried out with a weak irradiation in a degree that does not completely decompose the metal organic compound, and the next irradiation is carried out with a strong irradiation capable of changing the metal organic compound to an oxide.

(5) The method for producing a metal oxide according to any one of the above (1) to (4), wherein the metal organic compound is a mixture of two or more compounds comprising different metals, and the obtainable metal oxide is a composite metal oxide comprising the different metals.

(6) The method for producing a metal oxide as stated in any one of the above (1) to (5), wherein the solution containing the metal organic compound contains an organic amine as a photosensitizer.

(7) The method for producing a metal oxide according to any one of the above (1) to (6), wherein the metal organic compound is a metal organic acid salt.

(8) The method for producing a metal oxide as stated in the above (7), wherein the metal of the metal organic acid salt is selected from the group consisting of iron, indium, tin, zirconium, cobalt, nickel, and lead.

(9) The method for producing a metal oxide as stated in the above (7) or (8), wherein the organic acid of the metal organic acid salt is selected from the group consisting of naphthenic acid, 2-ethylhexanoic acid, caprylic acid, stearic acid, lauric acid, butyric acid, propionic acid, oxalic acid, citric acid, lactic acid, benzoic acid, salicylic acid, and ethylenediaminetetraacetic acid.

(10) The method for producing a metal oxide as stated in the above (7), wherein the metal organic acid salt is selected from the group consisting of iron 2-ethylhexanoate, indium 2-ethylhexanoate, and tin 2-ethylhexanoate.

(11) The method for producing a metal oxide according to any one of the above (1) to (6), wherein the metal organic compound is a metal acetylacetonato complex.

(12) The method for producing a metal oxide as stated in the above (11), wherein the metal of the metal acetylacetonato complex is selected from the group consisting of titanium, indium, tin, zirconium, and zinc.

(13) The method for producing a metal oxide as stated in the above (11) or (12), wherein the solvent for dissolving the metal acetylacetonato complex is selected from the group consisting of butyl acetate, toluene, acetylacetone, and methanol.

(14) The method for producing a metal oxide according to any one of the above (1) to (6), wherein the metal organic compound is a metal alkoxide having an organic group with 6 or more carbon atoms.

(15) The method for producing a metal oxide as stated in the above (14), wherein the metal of the metal alkoxide is titanium.

(16) The method for producing a metal oxide as stated in the above (14), wherein the alkoxyl group of the metal alkoxide is a 2-ethylhexanol group.

(17) A method for forming a minute pattern, comprising the steps of: subjecting a thin film layer containing a metal organic compound provided on a substrate, to irradiation with a laser light of a 400 nm or less wavelength according to a predetermined pattern shape or through a predetermined mask pattern, to form a metal oxide, and dissolving and removing the non-irradiated part with a solvent, to form a minute pattern.

(18) The method for forming a minute pattern as stated in the above (17), wherein the laser light irradiation of a 400 nm or less wavelength is carried out in a plurality of steps.

(19) The method for forming a minute pattern as stated in the above (17) or (18), wherein the laser light irradiation of a 400 nm or less wavelength is carried out in a plurality of steps, and wherein the first-step irradiation is carried out with a weak irradiation in a degree that does not completely decompose the metal organic compound, and the next irradiation is carried out with a strong irradiation capable of changing the metal organic compound to an oxide.

(20) The method for forming a minute pattern as stated in any one of the above (17) to (19), wherein, after the minute-pattern formation, the minute pattern is used as a mask to carry out dry etching, thereby forming a minute pattern on the substrate.

A metal oxide and a film comprising a metal oxide obtained by the method of the present invention is formed on a substrate.

As the substrate to be used, in general, any substrate can be used, as long as it has a smooth surface and is physically, chemically, and mechanically stable in air at a room temperature, and thus a metal or a metal oxide, and a single crystal or a polycrystal thereof, can be used. In either case it is not limited to a specific type but can be optionally selected and used as needed. Specific examples thereof include Si, $SiO_2$, MgO, $SrTiO_3$, $LaAlO_3$, and $\alpha$-$Al_2O_3$. The surface of the substrate should be maintained cleanly.

For that purpose, a washing operation is applied on the substrate surface. Wet washing or dry washing is adopted in the washing operation. Examples of the wet washing include chemical methods, such as dissolving removal (elimination), oxidation decomposition, and surface layer etching, followed by washing with pure water after application of the chemical method. Furthermore, in addition to the chemical methods, physical methods can be performed as well. Examples thereof include brush washing, high-pressure water jet washing, and supersonic wave washing.

In the methods of the present invention, a metal organic compound is used. It is used after applying a solution, obtained by dissolving a metal organic compound in a solvent, on a substrate and drying.

The organic group(s) constituting the metal organic compound plays the role of isolating metal ions, to be the cores with each other, by the steric hindrance effect, so that the ions do not undergo aggregation, crystal growth, and powdering in forming an oxide by decomposition after application. As the above-mentioned organic group, any one capable of achieving the steric hindrance effect can be used.

Specific examples of the metal organic compound include an organic metal complex compound, a metal organic acid salt, and a metal alkoxide having 6 or more carbon atoms. The metal organic compounds can be used as a mixture of two or more kinds.

The organic metal complex is a compound constituted by coordination of an organic group(s) to a metal. Specific examples include a metal acetylacetonato.

The metal acetylacetonato is a metal complex formed by the bond of a metal to acetylacetone.

The metal acetylacetonato is not particularly limited, as long as the metal acetylacetonato of the targeted metal oxide becomes a solution by being dissolved in a solvent so as to be the metal oxide at the time of decomposition. As the metal, the metal which should be the component of the metal oxide to be obtained is selected. Specific examples of the metal include titanium, tin, indium, zirconium, zinc, cobalt, iron, and nickel. As the metal acetylacetonato, an acetylacetonato of these metals can be mentioned.

Moreover, the acetylacetonato can be an acetylacetonato salt. In the case of obtaining a composite metal oxide film, a mixture of acetylacetonato of the metal constituting the desired composite metal oxide film and another metal organic compound can be used.

The metal organic acid salt is a salt obtained by neutralizing various kinds of metal ions and various kinds of organic acids.

The organic acid is preferably a carboxylic acid, examples include an aliphatic carboxylic acid, an alicyclic carboxylic acid, and an aromatic carboxylic acid.

The aliphatic carboxylic acid preferably has 3 to 20 carbon atoms, such as monovaleic carboxylic acid, divaleic carboxylic acid, and polyvaleic carboxylic acid. The aliphatic group is preferably an alkyl group or an alkenyl group. These groups may have a substituent. In addition to an alkyl group, the substituent can be an alkyl ether group, an OH group, a halogen element, an amino group, or the like. Specific examples include 2-ethylhexanoic acid, caprylic acid, stearic acid, lauric acid, butyric acid, propionic acid, oxalic acid, citric acid, lactic acid, and ethylenediaminetetraacetic acid.

The alicyclic carboxylic acid has a COOH group as the substituent on an alicyclic hydrocarbon. An alkyl group can be another substituent. Specific examples include naphthenic acid.

The aromatic carboxylic acid has a COOH group as the substituent on an aromatic hydrocarbon. An alkyl group, an OH group, or the like can be another substituent. Specific examples include benzoic acid and salicylic acid.

As a metal constituting the metal organic acid salt, an alkali metal, an alkali earth metal, a transitional element, and an amphoteric element can be used. Specific examples of the metal include titanium, tin, lead, indium, zirconium, cobalt, iron, nickel, or the like.

In the case of obtaining a composite metal oxide, a mixture of organic acid salts of metals constituting the composite metal oxide, or a mixture of an organic acid metal salt and another organic metal compound is used. Accordingly, a composite metal oxide can be obtained.

The metal alkoxide is a compound with the hydrogen of a hydroxyl group in alcohols substituted by a metal.

As the metal alkoxy group, an alkoxy group, as an organic group having 6 or more (preferably 17 or less) carbon atoms, is used. In the case a metal alkoxide having 5 or less carbon atoms is used, for example, if isopropoxide of titanium is used, polycondensation occurs, while hydrolysis by the slight amount of water content generally existing in air, thereby becoming in the gel state. In that case, a result different from the decomposition by the laser irradiation is caused, and thus the object of the invention cannot be achieved.

Specific examples of the alkoxy group as an organic group having 6 or more carbon atoms include a 2-ethyl-1-hexanoyl group, a heptanoyl group, a 2-ethyl-1-heptanoyl group, an octanoyl group, a nonanoyl group, or the like.

As the metal constituting the metal alkoxide, titanium, indium, tin, zirconium, zinc, lead, cobalt, nickel, iron, or the like can be mentioned.

In the case of obtaining a composite metal oxide, a mixture of a metal alkoxide of a metal constituting the composite metal oxide, or a mixture of a metal alkoxide and another organic metal compound is used.

By dissolving the above-mentioned metal organic compound in a solvent, a metal organic compound solution is prepared. As to the amount of the solvent to be used, an amount capable of dissolving the metal organic compound is used.

The case of using a metal acetylacetonato will be explained as a specific example of an organic metal complex as the metal organic compound.

Metal acetylacetonatos have different solubilities in solvents. Since it should be dissolved homogeneously in a solvent in the methods of the present invention, an appropriate solvent can be selected. As the solvent, an organic solvent can be used. The organic solvent is one capable of dissolving a metal acetylacetonato. Examples of the solvents include hydrocarbons, which are non-polar solvents, such as hexane, octane, benzene, toluene, and tetralin. In addition to that, acetylacetone, alcohols, such as methanol, ethanol, and propanol; amines, pyridine, organic acids, such as acetic acid and propionic acid, and esters, such as butyl acetate, can be used as well. The organic solvents can be used alone or in combination of two or more, according to the kind of the metal acetylacetonato to be specifically used.

The metal concentration in the solvent can be determined according to the solubility of the metal acetylacetonato or the like. The metal concentration is generally 3 to 40% by weight, in terms of the weight of the metal acetylacetonato, and preferably 5 to 10% by weight. When the metal concentration is too small, it is not sufficient for production of a metal oxide film. On the other hand, when the concentration is too large, it is difficult to completely dissolve, and thus a sufficient result cannot be obtained. Generally, a necessary amount of a metal acetylacetonato is added into a solvent, and agitated sufficiently.

Preparation of the solution can be carried out by dissolving a metal acetylacetonato, preliminarily provided with a certain component composition, in a solvent, or a method of preliminarily preparing each solvent solution of various kinds of metal acetylacetonatos, and mixing the solvent solutions.

In the case of insufficient dissolution, a heating operation can be carried out. A solution accordingly obtained should have a specific property for the application on a substrate. For example, in the case of adopting a means of spin coating, since the solution needs to have a certain degree of viscosity, the viscosity of the solution can be adjusted by adding an appropriate amount of a polymer substance or the like, as a viscosity-adjusting agent.

When a metal organic acid salt is used as the metal organic compound, the solution thereof is prepared as follows.

In the case of dissolving each metal organic acid salt in a solvent, the solubility of the metal organic acid salts vary for different solvents.

Since the metal organic acid salt should be dissolved homogeneously in a solvent in the methods of the present invention, an appropriate solvent can be selected. As the solvent, an organic solvent can be used. The organic solvent should be capable of dissolving a metal organic acid salt. Examples of the solvent include hydrocarbons, which are non-polar solvents, such as hexane, octane, benzene, toluene, and tetralin. In addition to that, acetylacetone, alcohols, such as methanol, ethanol, and propanol; amines, pyridine, organic acids, such as acetic acid and propionic acid, and esters, such as butyl acetate, can be used as well. The organic solvents can be used alone or in combination of two or more, according to the kind of the metal organic acid salt to be specifically used.

The metal concentration in the solvent can be determined according to the solubility of the metal organic acid salt or the like. The metal concentration is generally 3 to 40% by weight, in terms of the weight of the metal organic acid salt, and preferably 5 to 10% by weight. When the metal concentration is too small, it is not sufficient for production of a metal oxide film. On the other hand, if the concentration is too large, it is difficult to completely dissolve, and thus a sufficient result cannot be obtained. Generally, a necessary amount of a metal organic acid salt is added into a solvent, and agitated sufficiently.

Preparation of the solution can be carried out by dissolving a metal organic acid salt, preliminarily provided with a certain component composition, in a solvent, or by a method of preliminarily preparing each solvent solution of various kinds of metal organic acid salts, and mixing the solutions containing the solvents.

In the case of insufficient dissolution, a heating operation can be carried out. A solution accordingly obtained should have a specific property for the application on a substrate. For example, in the case of adopting a means of spin coating, since the solution needs to have a certain degree of viscosity, the viscosity of the solution can be adjusted by adding an appropriate amount of a polymer substance or the like, as a viscosity-adjusting agent.

Metal alkoxides have different solubilities in solvents. Since it should be dissolved homogeneously in a solvent in the methods of the present invention, an appropriate solvent can be selected. As the solvent, an organic solvent can be used. The organic solvent should be capable of dissolving metal alkoxide. Examples of the solvent include hydrocarbons, which are non-polar solvents, such as hexane, octane, benzene, toluene, and tetralin. In addition to that, acetylacetone, alcohols, such as methanol, ethanol, and propanol; amines, pyridine, organic acids, such as acetic acid and propionic acid, and esters, such as butyl acetate, can be used as well. The organic solvents can be used alone or in combination of two or more, according to the kind of the metal alkoxide to be specifically used.

The metal concentration in the solvent can be determined according to the solubility of the metal alkoxide or the like. The metal concentration is generally 3 to 40% by weight, in terms of the weight of the metal alkoxide, and preferably 5 to 10% by weight. When the metal concentration is too small, it is not sufficient for production of a metal oxide film. On the other hand, if the concentration is too large, it is difficult to completely dissolve, and thus a sufficient result cannot be obtained. Generally, a necessary amount of a metal alkoxide is added into a solvent, and agitated sufficiently.

Preparation of the solution can be carried out by dissolving a metal alkoxide, preliminarily provided with a certain component composition, in a solvent, or a method of preliminarily preparing each solvent solution of various kinds of metal alkoxides, and mixing the solvent solutions.

In the case of insufficient dissolution, a heating operation can be carried out. A solution accordingly obtained should have a specific property for the application on a substrate. For example, in the case of adopting a means of spin coating, since the solution needs to have a certain degree of viscosity, the viscosity of the solution can be adjusted by adding an appropriate amount of a polymer substance or the like, as a viscosity-adjusting agent.

In obtaining an oxide film, a laser light of 400 nm or less wavelength is irradiated onto a substrate with a solution of a metal organic compound applied. A photosensitizer is preferably added into the solution of the metal organic compound, thereby absorption of the laser light can be improved, to have the wavelength of the irradiated laser light at 400 nm or less. The photosensitizer can be selected and used optionally from conventionally used photosensitizers, according to the wavelength. Specific examples thereof include an organic amine. Specific examples of the organic amine include monoethanol amine, diethanol amine, and triethanol amine.

When a solution of a metal organic compound is applied on the substrate, it is carried out as follows.

The solution of a metal acetylacetonato as the obtained organic metal complex compound, the organic metal acid salt solution, or the metal alkoxide solution, is applied on the support substrate, to form a layer on the substrate. As a means for applying these solutions onto the substrate, a means conventionally used for forming a thin film on a substrate can be optionally selected. Specifically, a solution application method can be used, and various conventionally known methods, such as a dipping (soaking) method, a spray method, a brush application method, and a spin coat method, can be used.

Then, the formed thin film-like coated (applied) layer is dried. The drying operation can be carried out by leaving the formed layer for a certain period of time in an atmosphere of about room temperature or warmer, or in a slightly heated atmosphere.

The specific procedure is as follows. The liquid film formed on the substrate is dried at a room temperature or under heating. For example, it can be carried out according to a method of raising the temperature to 150° C. over 15 minutes in air, at a temperature-increase rate of 10° C./min, maintaining at the same temperature for 15 minutes, and furnace-cooling. The thickness of the film formed on the substrate can finally be in the range of about 1 nm to 10 $\mu$m.

The irradiation of the laser light of 400 nm or less wavelength can be carried out as follows.

A substrate is set in a substrate holder in air or an atmosphere-controllable chamber, so that a laser light is irradiated thereto, with a certain light intensity and repetition number.

The kind of the light source, the light intensity, the repetition rate (pulse or continuous), the substrate temperature, and the atmosphere can be selected optionally according to the kind of the metal organic compound to be the subject.

The above can be optionally selected in consideration of the physical properties, such as the absorption characteristics with respect to the thin film layer of the metal acetylacetonato solution as the organic metal complex and the metal organic acid salt solution.

A short-wavelength laser to be used in the present invention, does not have self-absorption by the use of an inert gas compound, which is unstable at the ground state. By changing the gas to be used, strong pulse lights of 400 nm or less can be obtained. They have a high repetition frequency, with a pulse width of several ns and a top output of several MW or more.

Examples of the light source used in the light irradiation include excimer lasers, such as an ultraviolet ray laser XeF (351 nm), XeCl (308 nm), KrF (248 nm), ArF (193 nm), and $F_2$ (157 nm); and Ar ion laser (second higher harmonic wave: 257 nm), each of which has little heating effect.

Since the transmittance of the optical material is reduced according to shortening of the wavelength, a KrF (248 nm) laser is adequate as the light source for adopting a dioptric system using a lens.

The specific conditions can be mentioned as follows.

An ArF excimer laser (193 nm) light is irradiated, at a 1 to 20 Hz laser repetition number, and a laser fluence in the range of 10 to 70 mJ/cm$^2$, for a period of time of about 3 to about 15 minutes. More specifically, an ArF excimer laser (193 nm) light is applied at 10 Hz and 50 mJ/cm$^2$ for 5 minutes, or the like.

Generally, the laser light irradiation is carried out in air, but if a non-stoichiometric property exists in the metal oxide, control of the atmosphere, such as performing the irradiation in hydrogen, in nitrous oxide, in nitrogen, or in ozone, is required.

Accordingly, the applied metal-containing organic compound can be decomposed, as well as that a crystallized metal oxide thin film can be formed.

In the present invention, it is also effective to carry out the laser irradiation in a plurality of steps of at least two steps. One compound that cannot be decomposed in one step can be decomposed completely by carrying out the laser irradiation in a plurality of steps. The method of carrying out the irradiation in a plurality of steps, such as two steps, is particularly effective in the case of utilizing a metal organic acid salt as the metal organic compound. In decomposing the metal organic acid salt in a plurality of steps, a metal organic acid salt, which is stable and thus generally resists decomposition in one step, can be decomposed.

In carrying out the laser irradiation in a plurality of steps, it is particularly effective to irradiate with a weaker energy in the first step with respect to the subsequent step. This is effective because, if irradiation is carried out with a strong energy from the beginning, decomposition of the metal organic acid salt may not be done when a metal organic salt is used as the metal-containing organic compound. One reason decomposition may not be done as described above is considered to be the possibility of ablation of the metal organic acid salt as the raw material.

Because ablation may be caused by overly strong energy irradiation by a laser, a weak-output irradiation, or irradiation with the specimen maintained at an extremely low temperature, is effective in the first step.

As the reason decomposition is carried out preferably by irradiating with weak energy by a laser in the first step, and subsequently irradiating with energy (in particular, stronger energy), stabilization of the metal organic acid salt (such as iron 2-ethylhexanoate) and an increase of the interaction between iron 2-ethylhexanoate molecules and the substrate, according to elimination of the solvent in advance, in the first preliminary step, can be considered.

For example, it is presumed that, with the irradiation of the weak laser light in the first step in the plurality of laser light irradiation steps, the metal organic compound can be excited to a semi-stable state, and affinity of the metal organic compound (e.g. a metal organic acid salt) to the substrate may increase, to cause a certain kind of bond between them. According to that, it is expected that the metal organic compound can be effectively decomposed and converted to a metal oxide by the subsequent step of irradiation with the stronger laser light. Contrary to the above, in the case, for example, of a certain metal organic acid salt, when the compound is irradiated with the stronger laser light from the beginning without a preliminary irradiation with a weak laser light, the metal organic acid salt molecules may easily be evaporated (devolatilized), and no desirable oxide can result.

The energy irradiation by a laser according to the present invention can be preferably carried out by irradiating an energy of a degree that does not completely decompose the metal organic acid salt in the first step, and subsequently irradiating an energy of a degree capable of decomposing the metal organic acid salt.

Examples of the specific conditions of the laser irradiation can be mentioned as follows.

An ArF excimer laser (193 nm) is used for carrying out the first irradiation at 10 mJ/cm$^2$ and 50 Hz for 30 seconds, and the subsequent irradiation at 50 mJ/cm$^2$ and 10 Hz for 5 minutes.

An ArF excimer laser (193 nm) is used for carrying out the first irradiation at 10 mJ/cm$^2$ and 50 Hz for 60 seconds, and the subsequent irradiation at 50 mJ/cm$^2$ and 10 Hz for 5 minutes.

An ArF excimer laser (193 nm) is used for carrying out the first irradiation at 10 mJ/cm$^2$ and 50 Hz for 30 seconds, and the subsequent irradiation at 50 mJ/cm$^2$ and 10 Hz for 2.5 minutes.

According to the multi-step laser irradiation, production of a metal oxide film, which was difficult to be formed in the case of one-step decomposition (the case of a metal organic acid salt, particularly one-step irradiation with the stronger laser light), selective control of an oxide layer (in the case of irradiating a laser light to Ti (IV) 2-ethyl-1-hexanolate, a rutile phase is obtained by one-step irradiation, and an anatase phase is obtained by two-step irradiation), and synthesis of a composite oxide at a room temperature (a single phase of a $PbTiO_3$ composite oxide can be obtained) are enabled.

According to the present invention, by the above-mentioned treatment, an organic metal complex or a metal organic acid salt, etc., which is the applied metal organic compound, can be decomposed, as well as that a crystallized oxide thin film comprising the metal of the above-mentioned metal organic compound, can be formed as a film on the substrate. Specifically, when titanium, tin, indium, zirconium, cobalt, iron, nickel, lead, or zinc is used as the metal, titanium oxide, tin oxide, indium oxide, zirconium oxide, cobalt oxide, iron oxide, nickel oxide, lead oxide, and zinc oxide can be obtained, respectively. In the case of using a plurality of metals as the raw material substance, a composite metal oxide can be obtained.

Confirmation of the metal oxide accordingly produced can be carried out by X-ray diffraction or the like. The metal oxide accordingly obtained can be used after separating it from the substrate.

In the formation of a metal oxide film according to the present invention, a patterning operation can be carried out at the same time. For example, in the case of forming a transparent conductive film in the field of microoptics or electronics, a thin film is formed only at the necessary parts, or a minute patterning, on the micron order, is carried out on the thin film surface. For example, patterning of a sol-gel thin film is carried out, in general, by a combination of lithography and etching with respect to a metal oxide after the final heat treatment.

According to the present invention, by the irradiation of a laser light of a 400 nm or less wavelength with respect to a thin film layer of a metal-containing organic compound on a substrate, a metal oxide insoluble with a solvent can be obtained directly.

By ultraviolet-ray irradiation to an applied film through a mask, and eliminating the non-irradiated part by a solvent, a minute patterning can be carried out in the laser film formation process.

The specific operation is as follows.

In a pattern-forming operation of a metal oxide according to the present invention, one selected from the group consisting of an organic metal complex, a metal organic acid salt, and a metal alkoxide, as the metal organic compound to be provided on a substrate, is dissolved in a solvent so as to form a thin film layer on the substrate, and a laser light of a 400 nm or less wavelength is irradiated thereto according to a certain pattern shape or through a certain mask pattern. The light-irradiation condition is the same as the above-mentioned case of irradiation for producing a metal oxide.

Since a thin film layer comprising a metal organic compound becomes a metal oxide in the irradiated part subject to a laser light irradiation of a 400 nm or less wavelength, the solubility with respect to the above-mentioned organic solvent is remarkably lowered. According to a developing process using the above-mentioned organic solvent in this state, the non-irradiated part can be dissolved and eliminated selectively, so that only the irradiated part can remain, so as to form a resist pattern accurately reproducing the original picture. The developing process can be carried out, in general, by the conventionally and commonly used dipping method, but the brush-out method and the blowing method can be used as well.

As the above-mentioned organic solvent, in addition to the solvents used in dissolving a metal organic compound, for example, aromatic hydrocarbons, such as benzene, toluene, xylene, and ethyl benzene; aliphatic halogenated hydrocarbons, such as methylene dichloride, ethylene dichloride, chloroform, and carbon tetrachloride; and aromatic halogenated hydrocarbons, such as monochlorobenzene, can be used in combination.

Since a metal oxide pattern accordingly formed has high chemical durability and excellent dry-etching durability, a substrate can be applied with an etching treatment with high accuracy by using the resist pattern as a mask. For the etching treatment of the substrate, a dry etching treatment can be preferably used. Accordingly, a minute pattern with a high aspect ratio can be formed easily with high resolution.

According to the present invention, a novel method for forming a crystalline metal oxide thin film by applying a solution containing a metal organic compound onto a substrate, and irradiating with laser light of 400 nm or less wavelength, was enabled. Moreover, by irradiating a laser light to an applied film through a mask, and thereafter eliminating the non-irradiated part by a solvent, a minute patterning can be obtained.

According to the method of the present invention, unlike the conventional methods, a targeted metal oxide which is formed on a substrate can be obtained, without a step of heat treatment at a high temperature. The metal oxide formed on the substrate is produced according to the production process without including a step of high-temperature heating. Accordingly, for example, in the case of a metal oxide formed on a silicon substrate, one without silicon deterioration or reaction among the laminated films, can be obtained. Moreover, in the case of PZT, which is expected as a dielectric memory, one without reaction of the PbO component with the silicon substrate or lowering of the dielectric characteristics, can be obtained. Furthermore, in the case of a transparent conductive film, such as indium oxide, since the film is formed at a low temperature, one having good characteristics for use as an electrode of photonics or electronics devices related to a light, such as a liquid crystal display board, a plasma display panel, and a solar battery, can be obtained.

Moreover, according to the plural-stage laser light irradiation, a metal oxide film, which cannot be obtained by one step, can be obtained, as well as that selective control of a specific oxide phase can be enabled, and thus synthesis of a composite oxide can be enabled at a room temperature.

The present invention is described in more detail, based on the following examples, but the invention is not limited to those.

EXAMPLES

Example 1

A commercially available quartz substrate was washed with a neutral detergent, and then with pure water. Thereafter, it was treated by a supersonic wave washing in acetone for 10 minutes, followed by drying at 100° C. for 10 minutes. The raw material solution was prepared by diluting iron 2-ethylhexanoate solution (Fe content 6 wt %) two-fold with toluene. After spin-coating the raw material solution on the quartz substrate at 2,000 rpm for 10 seconds, it was dried at 200° C. for 10 minutes. After the drying operation, an ArF excimer laser (193 nm) light was irradiated to the iron 2-ethylhexanoate at 10 mJ/cm$^2$ and 50 Hz for 30 seconds, and further, at 50 mJ/cm$^2$ and 10 Hz. for 5 minutes, in air. According to the X-ray diffraction measurement thereof, production of a $\gamma Fe_2O_3$ film on the irradiated part was confirmed.

Example 2

In the same manner as in Example 1, a quartz substrate was washed and dried. A raw material solution, prepared by dissolving indium 2-ethylhexanoate in a mixed solvent of toluene and acetylacetone, was spin-coated on the quartz substrate at 2,000 rpm for 10 seconds. After a drying operation, an ArF excimer laser (193 nm) light was irradiated to the indium 2-ethylhexanoate at 10 mJ/cm$^2$ and 50 Hz for 30 seconds in air. Subsequently, it was irradiated at 50 mJ/cm$^2$ and 10 Hz for 5 minutes in air. According to the X-ray diffraction measurement thereof, the product after the laser irradiation was identified as a crystalline $In_2O_3$.

Example 3

In the same manner as in Example 1, a quartz substrate was washed and dried. A raw material solution, prepared by dissolving tin 2-ethylhexanoate in a mixed solvent of toluene and acetylacetone, was spin-coated on the quartz substrate at 2,000 rpm for 10 seconds. After a drying operation, an ArF excimer laser (193 nm) light was irradiated to the tin 2-ethylhexanoate at 10 mJ/cm$^2$ and 50 Hz for 30 seconds in air. Subsequently, it was irradiated at 10 Hz and 50 mJ/cm$^2$ for 5 minutes in air. According to the X-ray diffraction measurement thereof, the product after the laser irradiation was identified as a crystalline $SnO_2$.

Example 4

A commercially available MgO single crystal substrate was washed with a neutral detergent, and then with pure water. Thereafter, it was treated by a supersonic wave washing in acetone for 10 minutes, followed by drying at 100° C. for 10 minutes. The raw material solution was prepared by diluting an acetylacetonatotitanium solution (Ti content 8.83 wt %) two-fold with n-butyl acetate. After spin-coating the solution on the MgO single crystal substrate at 3,000 rpm for 10 seconds, it was dried at 150° C. for 10 minutes. An ArF excimer laser (193 nm) light was irradiated to the acetylacetonatotitanium in air. The laser repetition number was changed in the range of 1 to 20 Hz, and the laser fluence in the range of 10 to 70 mJ/cm$^2$. The laser irradiation effect was evaluated by the infrared absorption spectrum and X-ray diffraction measurement thereof. The infrared absorption spectrum was measured, using a control of the same substance of the film on the MgO single crystal substrate applied with a spin coating.

Results are as follows.

After the drying operation, decomposition of the acetylacetonatotitanium was not observed. In contrast, after the ArF excimer laser irradiation, disappearance of the infrared absorption spectra at 1,356 $cm^{-1}$, 1,415 $cm^{-2}$, $CH_3$ degenerate angle change, 1,534 $cm^{-1}$, CO stretching, 1,580 $cm^{-1}$, CC stretching was observed. Moreover, according to the results in the X-ray diffraction measurement, with the laser of 10 to 20 $mJ/cm^2$ fluence, an amorphous phase was identified, whereas with the laser of 30 to 70 $mJ/cm^2$ fluence, a rutile phase was identified. From these results, it was confirmed that $TiO_2$ could be obtained by the laser light irradiation.

Example 5

The experiment operation was carried out in the same manner as in Example 4, except that, in place of the acetylacetonatotitanium used in Example 4, acetylacetonatoindium was used. A raw material solution, prepared by dissolving the acetylacetonatoindium in a mixed solvent of toluene and acetylacetone, was spin-coated on a quartz substrate at 3,000 rpm for 10 seconds. After a drying operation, an ArF excimer laser (193 nm) light was irradiated to the acetylacetonatoindium at 10 Hz and 50 $mJ/cm^2$ for 5 minutes in air. According to the X-ray diffraction measurement thereof, the film after the laser irradiation was identified as $In_2O_3$. Accordingly, it was understood that a crystalline $In_2O_3$ oxide could be obtained by ArF excimer laser irradiation to the acetylacetonato salt.

Example 6

The experiment operation was carried out in the same manner as in Example 4, except that, in place of the acetylacetonatotitanium used in Example 4, acetylacetonatotin was used. A raw material solution, prepared by dissolving the acetylacetonatotin two-fold in n-butyl acetate, was spin-coated on a quartz substrate at 3,000 rpm for 10 seconds. After a drying operation, an ArF excimer laser (193 nm) light was irradiated thereto at 10 Hz and 50 $mJ/cm^2$ for 5 minutes in air. According to the X-ray diffraction measurement thereof, the film after the irradiation was identified as $SnO_2$. Accordingly, it was understood that a crystalline $SnO_2$ could be obtained by ArF excimer laser irradiation to the acetylacetonato salt.

Example 7

The experiment operation was carried out in the same manner as in Example 4, except that, in place of the acetylacetonatotitanium used in Example 4, acetylacetonatozirconium was used. A raw material solution, prepared by dissolving the acetylacetonatozirconium in methanol, was spin-coated on a quartz substrate at 3,000 rpm for 10 seconds. After a drying operation, an ArF excimer laser (193 nm) light was irradiated thereto at 10 Hz and 50 $mJ/cm^2$ for 5 minutes in air. According to the X-ray diffraction measurement thereof, the film after the irradiation was identified as monoclinic $ZrO_2$. Accordingly, it was understood that a crystalline $ZrO_2$ could be obtained by ArF excimer laser irradiation to the acetylacetonato salt.

Example 8

The experiment operation was carried out in the same manner as in Example 4, except that, in place of the MgO single crystal substrate used in Example 4, an $SnO_2$ fluorine-doped substrate, an $SrTiO_3$ single crystal substrate, and a quartz substrate were used, respectively. Spin coating was applied to each substrate at 3,000 rpm for 10 seconds. Then, an ArF excimer laser was irradiated to the acetylacetonatotitanium applied on each of the substrates. According to the X-ray diffraction measurement thereof, each of the films after the laser irradiation was identified as $TiO_2$. Accordingly, it was understood that a crystalline oxide could be obtained by ArF excimer laser irradiation to the acetylacetonato salt regardless of the substrate.

Example 9

Ti (IV) 2-ethyl-1-hexanolato was diluted two-fold with methanol. The solution was spin-coated on a quartz substrate at 4,000 rpm for 10 seconds. After drying the substrate at 150° C. for 10 minutes, an ArF excimer laser (193 nm) light was irradiated thereto at 50 Hz and 10 $mJ/cm^2$ for 60 seconds, and subsequently at 10 Hz and 50 $mJ/cm^2$ for 2.5 minutes in air. As a result, a $TiO_2$ anatase phase was obtained in the irradiated part.

Example 10

The experiment operation was carried out in the same manner as in Example 9, except that an ArF excimer laser (193 nm) light was irradiated to Ti (IV) 2-ethyl-1-hexanolato at 10 Hz and 50 $mJ/cm^2$ for 5 minutes in air. As a result, a $TiO_2$ rutile phase was obtained in the irradiated part.

Example 11

Ti (IV) 2-ethyl-1-hexanolato and lead 2-ethylhexanoate, with a 1:1 composition ratio, were dissolved in toluene. The mixed solution was spin-coated on a quartz substrate at 4,000 rpm for 10 seconds. After drying at 150° C. for 10 minutes, an ArF excimer laser (193 nm) light was irradiated thereto at 10 $mJ/cm^2$ and 50 Hz for 30 seconds, and subsequently at 50 $mJ/cm^2$ and 10 Hz for 5 minutes in air. As a result, a composite oxide $PbTiO_3$, comprising a single phase, was obtained.

Comparative Example 2

The experiment operation was carried out in the same manner as in Example 11, except that an ArF excimer laser (193 nm) light was irradiated at 10 Hz and 50 $mJ/cm^2$ for 5 minutes in air. As a result, the irradiated part had a $TiO_2$ rutile phase.

Having described our invention as related to the present embodiments, it is our intention that the invention not be limited by any of the details of the description, unless otherwise specified, but rather be construed broadly within its spirit and scope as set out in the accompanying claims.

What we claim is:

1. A method for producing a metal oxide, comprising the steps of:

dissolving a metal organic compound in a solvent to provide a state of solution, applying the solution onto a substrate, drying the solution, and subjecting the resultant substrate to irradiation with a laser light of a 400 nm or less wavelength, to form a metal oxide on the substrate, wherein the laser light irradiation of a 400 nm or less wavelength is carried out in a plurality of steps comprising a first irradiation step carried out with a weak irradiation to a degree that does not completely decompose the metal organic compound, followed by an irradiation step carried out with a strong irradiation that changes the metal organic compound to an oxide, provided that the metal organic compound is not a metal alkoxide having an organic group with 5 or less carbon atoms.

2. The method for producing a metal oxide as claimed in claim 1, wherein an excimer laser, which uses one selected from the group consisting of ArF, Krf, XeCl, XeF, and $F_2$, is used as the laser light of a 400 nm or less wavelength.

3. The method for producing a metal oxide as claimed in claim 1, wherein the metal organic compound is a mixture of two or more compounds comprising different metals, and the obtainable metal oxide is a composite metal oxide comprising the different metals.

4. The method for producing a metal oxide as claimed in claim 1, wherein the solution containing the metal organic compound contains an organic amine as a photosensitizer.

5. The method of claim 1, wherein the first weak irradiation step is carried out with an irradiation of 50 Hz and the subsequent strong irradiation is carried out with an irradiation of 10 Hz.

6. The method for producing a metal oxide as claimed in claim 1, wherein the metal organic compound is a metal organic acid salt.

7. The method for producing a metal oxide as claimed in claim 6, wherein the metal of the metal organic acid salt is selected from the group consisting of iron, indium, tin, zirconium, cobalt, nickel, and lead.

8. The method for producing a metal oxide as claimed in claim 6, wherein the organic acid of the metal organic acid salt is selected from the group consisting of naphthenic acid, 2-ethylhexanoic acid, caprylic acid, stearic acid, lauric acid, butyric acid, propionic acid, oxalic acid, citric acid, lactic acid, benzoic acid, salicylic acid, and ethylenediaminetetraacetic acid.

9. The method for producing a metal oxide as claimed in claim 6, wherein the metal organic acid salt is selected from the group consisting of iron 2-ethylhexanoate, indium 2-ethylhexanoate, and tin 2-ethylhexanoate.

10. The method for producing a metal oxide as claimed in claim 1, wherein the metal organic compound is a metal acetylacetonato complex.

11. The method for producing a metal oxide as claimed in claim 10, wherein the metal of the metal acetylacetonato complex is selected from the group consisting of titanium, indium, tin, zirconium, and zinc.

12. The method for producing a metal oxide as claimed in claim 10, wherein the solvent for dissolving the metal acetylacetonato complex is selected from the group consisting of butyl acetate, toluene, acetylacetone, and methanol.

13. The method for producing a metal oxide as claimed in claim 1, wherein the metal organic compound is a metal alkoxide having an organic group with 6 or more carbon atoms.

14. The method for producing a metal oxide as claimed in claim 13, wherein the metal of the metal alkoxide is titanium.

15. The method for producing a metal oxide as claimed in claim 13, wherein the alkoxyl group of the metal alkoxide is a 2-ethylhexanol group.

16. A method for forming a minute pattern, comprising the steps of:

dissolving a metal organic compound in a solvent to provide a state of solution;

applying the solution onto a substrate;

drying the solution to form a thin film layer containing the metal organic compound provided on the substrate, subjecting the thin film layer on the substrate to irradiation with a laser light of 400 nm or less wavelength according to a predetermined pattern shape or through a predetermined mask pattern, to form a metal oxide, and dissolving and removing the non-irradiated part with a solvent, to form a minute pattern, wherein the laser light irradiation of a 400 nm or less wavelength is carried out in a plurality of steps comprising a first irradiation step carried out with a weak irradiation to a degree that does not completely decompose the metal organic compound, followed by an irradiation step carried out with a strong irradiation that changes the metal organic compound to an oxide;

provided that the metal organic compound is not a metal alkoxide having an organic group with 5 or less carbon atoms.

17. The method for forming a minute pattern as claimed in claim 16, wherein, after the minute-pattern formation, the minute pattern is used as a mask to carry out dry etching, thereby forming a minute pattern on the substrate.

18. The method of claim 16, wherein the first weak irradiation step is carried out with an irradiation of 50 Hz and the subsequent strong irradiation is carried out with an irradiation of 10 Hz.

* * * * *

UNITED STATES PATENT AND TRADEMARK OFFICE

CERTIFICATE OF CORRECTION

PATENT NO. : 6,576,302 B1
DATED : June 10, 2003
INVENTOR(S) : Mizuta et al.

It is certified that error appears in the above-identified patent and that said Letters Patent is hereby corrected as shown below:

Title page,
Item [56], References Cited, FOREIGN PATENT DOCUMENTS, please add the following:
-- JP 1-294506 A 11/1989 --

Signed and Sealed this

Twenty-fourth Day of February, 2004

JON W. DUDAS
*Acting Director of the United States Patent and Trademark Office*